US005158622A

United States Patent [19]

Reichgott et al.

[11] Patent Number: 5,158,622

[45] Date of Patent: Oct. 27, 1992

[54] METHOD AND COMPOSITION FOR TREATMENT OF ALUMINUM

[75] Inventors: David W. Reichgott, Richboro; Fu Chen, Newtown, both of Pa.

[73] Assignee: Betz Laboratories, Inc., Trevose, Pa.

[21] Appl. No.: 654,159

[22] Filed: Feb. 12, 1991

[51] Int. Cl.[5] ..... C23C 8/00

[52] U.S. Cl. ..... 148/247; 148/251

[58] Field of Search ..... 148/247, 251

[56] References Cited

U.S. PATENT DOCUMENTS

| | | | |
|---|---|---|---|
| 4,136,073 | 1/1979 | Muro et al. | 260/29.2 |
| 4,191,596 | 6/1990 | Dollman et al. | 148/247 |
| 4,471,100 | 9/1984 | Tsubakimoto et al. | 525/367 |
| 4,500,693 | 2/1985 | Takehara et al. | 526/240 |
| 4,709,091 | 11/1987 | Fukumoto et al. | 562/595 |
| 4,847,410 | 7/1989 | Lickei et al. | 562/583 |
| 4,861,429 | 8/1989 | Barnett et al. | 162/199 |
| 4,872,995 | 10/1989 | Chen et al. | 210/699 |
| 4,895,622 | 1/1990 | Barnett et al. | 162/199 |
| 4,913,822 | 4/1990 | Chen et al. | 210/699 |
| 4,921,552 | 5/1990 | Sander et al. | 14.8/247 |
| 4,929,362 | 5/1990 | Chen | 210/701 |
| 4,959,156 | 9/1990 | Lickei et al. | 210/701 |

FOREIGN PATENT DOCUMENTS 56-155692 12/1981 Japan .

*Primary Examiner*—Sam Silverberg

*Attorney, Agent, or Firm*—Alexander D. Ricci; Steven D. Boyd

[57] ABSTRACT

Methods of forming a dried in place conversion coating on metal surfaces such as aluminum and aluminum alloys. The methods comprise contacting the metal with an aqueous solution of a water soluble maleic or acrylic acid/allyl ether copolymer alone or with an acid.

9 Claims, No Drawings

METHOD AND COMPOSITION FOR TREATMENT OF ALUMINUM

FIELD OF THE INVENTION

The present invention relates generally to non-chromate coatings for metals. More particularly, the present invention relates to a siccative, non-chromate coating for aluminum which improves the corrosion resistance and adhesion of paints to the surface. The present invention provides a dried in place coating which is particularly effective at treating aluminum coil and formed aluminum.

BACKGROUND OF THE INVENTION

The purposes of the formation of a chromate conversion coating on the surface of aluminum are to provide corrosion resistance, improve adhesion of coatings and for esthetic reasons. The conversion coating improves the adhesion of coating layers such as paints, inks, lacquers and plastic coatings. A chromate conversion coating is typically provided by contacting aluminum with an aqueous composition containing hexavalent or trivalent chromium ions, phosphate ions and fluoride ions. Growing concerns exist regarding the pollution effects of the chromate and phosphate discharged into rivers and waterways by such processes. Because of high solubility and the strongly oxidizing character of hexavalent chromium ions, conventional chromate conversion processes require extensive waste treatment procedures to control their discharge. In addition, the disposal of the solid sludge from such waste treatment procedures is a significant problem.

Attempts have been made to produce an acceptable chromate-free conversion coating for aluminum. Chromate-free pretreatment coatings based upon complex fluoacids and polyacrylic acids are known in the art, however they have not enjoyed widespread commercial acceptance. U.S. Pat. No. 4,191,596 which issued to Dollman et al., discloses a composition for coating aluminum which comprises a polyacrylic acid and $H_2ZrF_6$, $H_2TiF_6$ or $H_2SiF_6$. The '596 disclosure is limited to a water soluble polyacrylic acid or water dispersible emulsions of polyacrylic acid esters in combination with the described metal acids at a pH of less than about 3.5.

U.S. Pat. No. 4,921,552 which issued to Sander et al., discloses a non-chromate coating for aluminum which is dried in place which forms a coating having a weight from about 6 to 25 milligrams per square foot. The aqueous coating composition consists essentially of more than 8 grams per liter dihydrohexafluozirconic acid, more than 10 grams per liter of water soluble acrylic acid and homopolymers thereof and more than 0.17 grams per liter hydrofluoric acid. The disclosure notes that it was believed that copolymers of acrylic acid would also be effective, however, no examples were given.

U.S. Pat. No. 4,136,073 which issued to Muro et al., discloses a composition and process for the pretreatment of aluminum surfaces using an aqueous acidic bath containing a stable organic film forming polymer and a soluble titanium compound. The disclosed polymers include vinyl polymers and copolymers derived from monomers such as vinyl acetate, vinylidene chloride, vinyl chloride; acrylic polymers derived from monomers such as acrylic acid, methacrylic acid, acrylic esters, methacrylic esters and the like; aminoalkyl, epoxy, urethane-polyester, styrene and olefin polymers and copolymers; and natural and synthetic rubbers.

The use of allyl ether copolymers in non-analogous arts such as dust control, dispersants and water treatment is known. Japanese patent publication SH056-155692 entitled Method of Collecting Dust discloses the use of acrylic acid/polyethylene glycol monoallyl ether copolymers to treat the recirculating water in an aqueous dust collection system. U.S. Pat. No. 4,500,693 which issued to Takehara et al., discloses the use of copolymers composed of a (meth)acrylic acid and an allylic ether monomer which are useful as scale preventing agents in cooling water systems and wet dust collection systems, aqueous slurry dispersants in inorganic pigments, cement dispersants, and builders in detergents.

U.S. Pat. No. 4,471,100 which issued to Tsubakimoto et al., disloses a copolymer of maleic acid and polyethyleneglycol ether and its use as a cement dispersant, pigment dispersant, chelating agents and scale inhibitor.

U.S. Pat. Nos. 4,872,995 and 4,913,822 to Chen et al., and U.S. Pat. Nos. 4,861,429 and 4,895,622 to Barnett et al., disclose methods of using acrylic acid/polyethyleneglycol allyl ether copolymers in aqueous systems such as cooling water systems and paper making systems, as felt conditioners or to inhibit calcium oxalate deposition.

SUMMARY OF THE PRESENT INVENTION

The present invention provides a method of treating the surface of aluminum and alloys thereof in which aluminum is the primary component. It is believed that the methods of the present invention would also be effective at forming a coating on galvanized and cold rolled steel. The method of the present invention provides for the formation of a coating which increases the corrosion resistance and adhesion properties of the aluminum surface. The coating formed by the present invention may be dried in place or rinsed. The methods of the present invention comprise treating an aluminum surface with an aqueous treatment solution including a water soluble or water dispersible copolymer of maleic or acrylic acid and allyl ether alone or in combination with select acids.

The maleic or acrylic acid/allyl ether copolymers useful in accordance with the present invention has the structure Structure A

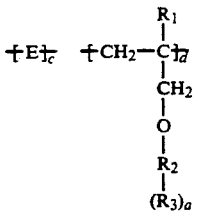

wherein E is the repeat unit remaining after polymerization of an alpha, beta ethylenically unsaturated compound, $R_1$ is H or lower (C1–C4) alkyl, $R_2$ is

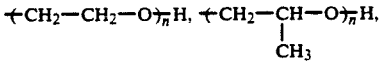

monohydroxylated C1–C8 alkyl, monohydroxylated C1–C8 alkylene, di- or polyhydroxy C1–C8 alkyl, dihydroxy or polyhydroxy C1–C8 alkylene, C1–C8 alkyl or C1–C8 alkylene, n is an integer of from 1 to about 20, a is 0 or 1, $R_3$ is hydrogen or an acetate formed by reacting an acetylating agent with an allyl ether, the molar ratio of repeat units c:d being from about 15:1 to about 1:10. The use of the above copolymers has been effective as an aluminum coating either alone or when used in combination with an acid selected from the group acetic acid, glycolic acid, dihydrohexafluotitanic acid, dihydrohexafluosilicic acid, dihydrohexafluorzirconic acid and fluoboric acid.

The water soluble or water dispersible copolymers used in accordance with the present invention are known. As discussed above, their known uses include the inhibition of calcium oxalate deposition, as dispersants in water systems and as an antifreeze component. However, use of the described copolymers as aluminum coating agents to improve corrosion resistance and adhesion of later applied coatings is believed to be new.

DETAILED DESCRIPTION OF THE PREFERRED EMBODIMENTS

The present inventors have discovered that an improved coating on articles of aluminum and aluminum alloys can be formed by an aqueous coating solution comprising a maleic or acrylic acid/allyl ether copolymer alone or in combination with a select acid. The combination was found to provide an aqueous pretreatment agent for the treatment of aluminum and aluminum alloys which provides improved corrosion resistance and adhesion of later applied coatings when the treatment is dried in place. The treatment of the present invention can optionally be rinsed after application as by a water bath or shower. The article can be aluminum coil or formed aluminum articles such as automotive heat exchangers such as radiators, condensers, and evaporators.

The water soluble or water dispersible polymers of the present invention comprise repeat units composed of an alpha, beta ethylenically unsaturated compound and an allyl alkylene ether based compound. The maleic or acrylic acid/allyl ether copolymers useful in accordance with the present invention have the general structure Formula I

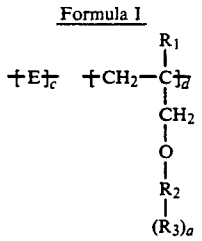

wherein E is the repeat unit remaining after polymerization of an alpha, beta ethylenically unsaturated compound, $R_1$ is H or lower (C1–C4) alkyl, $R_2$ is $$+CH_2-CH_2-O+_nH,\ +CH_2-\underset{\underset{CH_3}{|}}{CH}-O+_nH,$$

monohydroxylated C1–C8 alkyl, monohydroxylated C1–C8 alkylene, di- or polyhydroxy C1–C8 alkyl, dihydroxy or polyhydroxy C1–C8 alkylene, C1–C8 alkyl or C1–C8 alkylene, n is an integer of from about 1 to about 20, a is 0 or 1, $R_3$ is hydrogen or an acetate formed as a cap on the polyethyleneglycol allyl ether by reacting an acetylating agent with an allyl ether of polyethyleneglycol to produce an acetate capped polyethyleneglycol monoallyl ether which is then reacted with the alpha, beta ethylenically unsaturated compound E to form the copolymer of Formula I. Suitable acetylating agents include acetic acid, acetic anhydride, acetyl chloride, and the like as described in U.S. Pat. Nos. 4,959,156 and 4,847,410 fully incorporated herein by reference. The molar ratio of repeat unit c:d can range from about 15:1 to about 1:10.

A preferred copolymer of the present invention includes acrylic acid or maleic acid/polyethyleneglycol allyl ether copolymers of the general structure Formula II

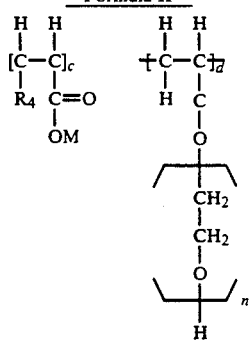

wherein $R_4$ is H or COOM, and M is H or a water soluble cation, n is from about 1 to about 20, preferably 1 to 15, c:d is from about 15:1 to about 1:10. Acrylic acid ($R_4$ equals H) may be replaced with maleic acid ($R_4$=COOH) in Formula II.

Another preferred copolymer is an acrylic acid or maleic acid/1 - allyloxy-2-propanol of the general formula Formula III

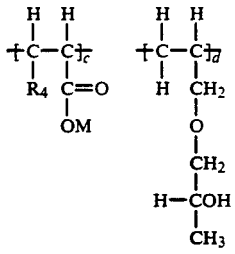

wherein $R_4$ and M as defined in Formula II and the molar ratio of c:d is from about 15:1 to about 1:10.

E of Formula I may, for an instance, comprise the repeat unit obtained after polymerization of an alpha, beta ethylenically unsaturated monomer, preferably a carboxylic acid, amide form thereof, or lower alkyl (C1–C6) ester or hydroxylated lower alkyl (C1–C5) ester of such carboxylic acids. Exemplary compounds encompassed by E include, but are not restricted to, the repeat unit formed by polymerization of acrylic acid, acrylamide, maleic acid or anhydride, fumaric acid, itaconic acid, 2-hydroxypropyl acrylate, styrene sulfonic acid, and 2-acrylamido-2-methylpropanesulfonic acid and the like. Water soluble salt forms of these acids are also within the purview of the invention.

The molar ratio c:d of the repeat units may fall within the range of about 30:1 to about 1:20, or desirably within the range of about 15:1 to about 1:10.

The number average molecular weight of the water soluble or water dispersible copolymers of Formulas I, II or III is not critical and may fall within the Mn range of about 1,000 to 10,000, desirably, 1,000 to 30,000 and more desirably 1,500 to 25,000. The key criterion is that the copolymer be water soluble or water dispersible. Water soluble or water dispersible terpolymers comprising monomer c and d of Formula I may also be effective for use in the present invention. Also, minor amounts of additional monomers may be added to the polymers.

The method of pretreating aluminum of the present invention entails the application of the chromium free acidic solution of the above copolymers to an aluminum surface. Preferably, the solution is dried in place on the surface of the metal to provide the desired coating weight. The application may be by any of several techniques familiar to those skilled in the art, such as roll coating, dip/squeegee, spray and the like. The copolymer in the treatment solution is preferably in the concentration range of from about 1 to 10 grams per liter of solution and the acid present in sufficient amounts to produce a pH of from about 1.5 to 3.5 in the acid/-copolymer solution. The presently preferred solution is the copolymer represented by Formula II where $R_4$ is H (i.e. acrylic acid), M=H or Na, c:d=3:1, and n=4; the copolymer concentration in the pretreatment solution is preferably about 2.5 grams per liter and the preferred acid is dihydrohexafluozirconic or dihydrohexafluotitanic acid in a concentration of about 12 grams per liter for dip/squeegee, roll coating or flow coating. For spray applications a lower concentration is typically employed.

The pretreatment solution of the present invention in practice may be formed from individual copolymer and acid components or preferably, may be supplied as a homogeneous copolymer/acid aqueous concentrate.

The present invention will now be further described with reference to a number of specific examples which are to be regarded solely as illustrative and not as restricting the scope of the present invention. In these examples, the effectiveness was evaluated with a variety of paint adhesion tests familiar to those skilled in the art. These tests include: "T-Bend" the tendency for paint to disadhere from a 180° bend in the metal (OT equals perfect); "Wedge Bend": the amount of paint (in millimeters) lost from the surface above the minimum radius of curvature of a bend in the metal. The bend is formed by first turning the painted metal through a radius of about 0.5 centimeters and then flattening an end of the bend to a zero radius; "Reverse Impact": tendency of paint to disadhere from deformed metal caused by an impact of known momentum on the reverse side of the test surface. This test may be done on dry test panels or panels subjected to boiling water prior to impact (10=perfect rating, noted in inch-pound impact); "Cross-Hatch/Reverse Impact": the tendency of paint to disadhere from areas between closely spaced lines through the paint scribed prior to reverse impact, the test may be done dry or following boiling water treatment (10=perfect rating); "Acetic Acid Salt Spray": per ASTM-B-287 (10=perfect rating).

In the following example copolymers of acrylic acid (AA) with polyethyleneglycol allyl ether (PEGAE) or 1-allyloxy-2-propanol (AOP) were prepared in substantial conformity to the procedures described in Example 7 through 10 of U.S. Pat. No. 4,872,995 incorporated herein by reference. The major exception was the relative ratios of reactants used and the molecular weight of the resulting polymers. Maleic acid (MA)/polyethylene glycol allyl ether copolymers were prepared in substantial conformity to the procedures described in U.S. Pat. No. 4,471,100 incorporated herein by reference. Table 1 summarizes the physical properties of the copolymers employed in the examples.

TABLE 1

| Copolymer Properties | | | | | |
|---|---|---|---|---|---|
| Copolymer # | Composition | Mole Ratio | Brookfield Viscosity cps, 25° C. | % Solids | pH |
| 1 | AA/PEGAE* | 3:1 | 32.6 | 25.3 | 5.8 |
| 2 | AA/PEGAE** | 3:1 | 23.0 | 24.2 | 6.1 |
| 3 | AA/AOP | 3:1 | 15.1 | 24.8 | 5.7 |
| 4 | MA/PEGAE* | 1:1 | 237.0 | 49.2 | 9.5 |
| 5 | MA/PEGAE** | 1.5:1 | 34.6 | 39.9 | 9.1 |

*4 moles of ethylene glycol
**9–10 moles of ethylene glycol

EXAMPLE 1

Aluminum test panels (3003 alloy) were cleaned by spraying with a commercial aqueous alkaline cleaner, rinsed with tap water, passed through squeegee rolls, and then treated by applying a solution of 2.5 or 10 grams per liter of copolymer 1 (see Table 1) which is a 3:1 copolymer of acrylic acid, sodium salt with four moles ethoxylated allyl alcohol, in deionized water with 12.2 grams per liter of either fluozirconic or fluotitanic acid. The solution was applied to the test panels which were spun to produce a thin film, and then dried in a stream of warm air. Coating weights were determined by weight differences before and after exposure to 35% nitric acid for four minutes. For comparison, corresponding solutions containing polyacrylic acid homopolymer (in place of the copolymer) as well as the fluoacid alone were also used. Two different paint systems were applied by draw-down bar and cured in accordance with the manufacturer's specifications. The test results are summarized in Tables 2 and 3.

TABLE 2

| Data for PPG Specialty Brown Polyester | | | | | | |
|---|---|---|---|---|---|---|
| Fluo-Acid (a) | Polymer Dose (g/l) (b) | Cross-Hatch Plus 40 in-lb Reverse Impact (c) | Cross-Hatch Plus 40 in-lb Reverse Impact (c) | T-Bend | Wedge Bend Loss (mm) | Acetic Acid Sal Spray 500 hr (c) |
| $H_2ZrF_6$ | 0.0 | 6 | 0 | 2 | 45 | 7, 7 |
| $H_2ZrF_6$ | 2.5 | 10 | 10 | 1 | 10 | 8.5, 9 |
| $H_2ZrF_6$ | 10.0 | 10 | 8 | 1 | 20 | 8.5, 8.5 |
| $H_2ZrF_6$ | 2.7 (d) | 10 | 10 | 2 | 14 | 7, 7 |
| $H_2TiF_6$ | 0.0 | 8 | 0 | 2 | 34 | 7.5, 7 |

TABLE 2-continued

| Data for PPG Specialty Brown Polyester | | | | | | |
|---|---|---|---|---|---|---|
| Fluo-Acid (a) | Polymer Dose (g/l) (b) | Cross-Hatch Plus 40 in-lb Reverse Impact (c) | Cross-Hatch Plus 40 in-lb Reverse Impact (c) | T-Bend | Wedge Bend Loss (mm) | Acetic Acid Sal Spray 500 hr (c) |
| $H_2TiF_6$ | 2.5 | 10 | 7 | 1 | 5 | 8, 8 |
| $H_2TiF_6$ | 10.0 | 9 | 0 | 2 | 24 | 8.5, 9 |
| $H_2TiF_6$ | 10.7 (d) | 10 | 10 | 1 | 2 | 7, 7 |
| 15% PT 1900 (e) | | 10 | 10 | 2 | 37 | 7.5, 7.5 |

(a) 12.2 g/l
(b) Copolymer 1 of Table 1 - unless noted
(c) Rating: 10 = no failure, 0 = total failure
(d) Polyacrylic acid
(e) Permatreat 1900, a proprietary chromium-based pretreatment from Betz Laboratories, Trevose, PA

TABLE 3

| Data for Valspar Brown Water-Based Polyester | | | |
|---|---|---|---|
| Fluo-Acid (a) | Polymer Dose (g/l) (b) | Boiling Water Cross-Hatch plus 40 in-lb Reverse Impact (c) | Condensing Humidity 240 hr (c) |
| $H_2ZrF_6$ | 0.0 | 0 | 0 |
| $H_2ZrF_6$ | 2.5 | 10 | 10 |
| $H_2ZrF_6$ | 10.0 | 10 | 10 |
| $H_2ZrF_6$ | 2.7 (d) | 0 | 10 |
| $H_2TiF_6$ | 0.0 | 0 | 0 |
| $H_2TiF_6$ | 2.5 | 9 | 9 |
| $H_2TiF_6$ | 10.0 | 10 | 10 |
| $H_2TiF_6$ | 10.7 (d) | 2 | 2 |
| 15% PT 1900 (e) | | 10 | 10 |

See Table 2 for Legend

As shown in Tables 2 and 3, the acrylic acid/allyl ether copolymers of the present invention are significantly more effective than polyacrylic acid solutions and comparable to a chromium based treatment. The preferred ratio of polymer to fluoacid in these tests was 2.5:12.

EXAMPLE 2

The procedures of Example 1 were followed however, different co-monomers were used along with acrylic acid and different paint systems were applied.

TABLE 4

| Data for Whittaker White Polyester | | | | | | | | |
|---|---|---|---|---|---|---|---|---|
| Fluo-Acid (a) | Polymer | Polymer Dose (g/l) | Cross-Hatch Plus 40 in-lb Reverse Impact (c) | Boiling Water Cross-Hatch Plus 40 in-lb Reverse Impact (c) | T-Bend | Wedge Bend Loss (mm) | Condensing Humidity 240 hr. (c) | Acetic Acid Salt Spray 500 hr. (c) |
| $H_2ZrF_6$ | Copolymer 1 | 2.5 | 10 | 10 | 1 | 7 | 0 | 9, 9 |
| $H_2ZrF_6$ | Copolymer 3 | 2.5 | 10 | 6 | 1 | 7 | 4 | 9.5, 9.5 |
| $H_2ZrF_6$ | Copolymer 3 | 10.0 | 10 | 9 | 2 | 10 | 1 | 9.5, 9.5 |
| $H_2ZrF_6$ | PAA (d) | 10.7 | 7 | 0 | 2 | 25 | 0 | 7.5, 7.5 |
| $H_2TiF_6$ | Copolymer 1 | 2.5 | 9 | 10 | 2 | 15 | 4 | 9, 9 |
| $H_2TiF_6$ | Copolymer 3 | 2.5 | 10 | 9 | 2 | 7 | 4 | 9, 9.5 |
| $H_2TiF_6$ | Copolymer 3 | 10.0 | 10 | 6 | 1 | 2 | 0 | 9.5, 9.5 |
| $H_2TiF_6$ | PAA (d) | 10.7 | 9 | 1 | 2 | 20 | 0 | 8, 8 |
| 15% PT 1500 (e) | | | 10 | 10 | 2 | 20 | 8 | 9.5, 9.5 |

See Table 2 for Legend

TABLE 5

| Data for Duracron S-630 White Enamel | | | | | |
|---|---|---|---|---|---|
| Fluo-Acid (a) | Polymer | Polymer Dose (g/l) | Boiling Water Cross-Hatch Plus 40 in-lb Reverse Impact (c) | Wedge Bend Loss (mm) | Condensing Humidity 240 hr. (c) |
| $H_2ZrF_6$ | Copolymer 1 | 2.5 | 10 | 10 | 10 |
| $H_2ZrF_6$ | Copolymer 2 | 2.5 | 10 | 12 | 10 |
| $H_2ZrF_6$ | Copolymer 3 | 2.5 | 10 | 17 | 7 |
| $H_2ZrF_6$ | PESA (b) | 2.5 | 4 | 10 | 10 |
| $H_2ZrF_6$ | PAA (d) | 10.7 | 10 | 14 | 10 |
| $H_2TiF_6$ | Copolymer 1 | 2.5 | 10 | 9 | 10 |
| $H_2TiF_6$ | Copolymer 2 | 2.5 | 10 | 15 | 10 |
| $H_2TiF_6$ | Copolymer 3 | 2.5 | 10 | 16 | 4 |
| $H_2TiF_6$ | PESA | 2.5 | 8 | 10 | 10 |

TABLE 5-continued

| Fluo-Acid (a) | Polymer | Polymer Dose (g/l) | Boiling Water Cross-Hatch Plus 40 in-lb Reverse Impact (c) | Wedge Bend Loss (mm) | Condensing Humidity 240 hr. (c) |
|---|---|---|---|---|---|
| | | Data for Duracron S-630 White Enamel | | | |
| $H_2TiF_6$ | PAA (d) | 10.7 | 10 | 22 | 10 |

(a) 12.2 g/l
(b) PESA denotes polyepoxysuccinic acid.
(c) Rating: 10 = no failure, 0 = total failure.
(d) Polyacrylic acid.
(e) Permatreat 1500, and 1510 are proprietary chromium-based pretreatments from Betz Laboratories; PT 1510 contains polyacrylic acid and was dosed to deliver 2.5 g/l polymer.

TABLE 6

| Fluo-Acid (a) | Polymer (b) | Polymer Dose (g/l) | Cross-Hatch Plus 40 in-lb Reverse Impact (c) | Boiling Water Cross-Hatch Plus 40 in-lb Reverse Impact (c) | T-Bend | Wedge Bend Loss (mm) |
|---|---|---|---|---|---|---|
| | | Data for Whittaker White Polyester | | | | |
| $H_2ZrF_6$ | Copolymer 1 | 2.5 | 10 | 10 | 3 | 20 |
| $H_2ZrF_6$ | Copolymer 4 | 2.5 | 10 | 10 | 2 | 23 |
| $H_2ZrF_6$ | Copolymer 5 | 250 | 10 | 10 | 2 | 29 |
| $H_2ZrF_6$ | PAA (d) | 10.7 | 10 | 10 | 2 | 24 |
| $H_2TiF_6$ | Copolymer 1 | 2.5 | 10 | 10 | 2 | 33 |
| $H_2TiF_6$ | Copolymer 4 | 2.5 | 10 | 10 | 2 | 20 |
| $H_2TiF_6$ | Copolymer 5 | 2.5 | 10 | 10 | 2 | 40 |
| $H_2TiF_6$ | PAA (d) | 10.7 | 10 | 9 | 2 | 27 |
| PT 1510 (d, e) | | 2.5 | 10 | 10 | 2 | 23 |

See Table 5 for Legend

As seen in Tables 4 through 6, the 4 mole ethoxylated allyl ether copolymers gave slightly better adhesion performance than the 9 mole homologues as shown by the wedge bend data. The allyloxypropanol copolymer was generally slightly inferior to the former ethoxylated allyl ether copolymer.

EXAMPLE 3

Methacrylic acid/PEGAE copolymer (2.5 grams/-liter) was combined with 12.2 grams/liter fluozirconic or fluotitanic acid. In both cases a precipitate appeared immediately and a homogeneous coating could not be formed. An analogous solution formed from maleic acid/diisobutylene with dihydrohexafluotitanic acid also gave a precipitate and homogeneous coatings could not be formed.

Example 3 shows that the poly(acrylic acid) and poly(epoxysuccinic acid) were substantially less effective than the copolymers of the present invention. Also, when a soluble sample of methacrylic acid/allyl ether copolymer or maleic acid/diisobutylene copolymer were combined with an aqueous solution of fluotitanic acid, the mixtures precipitated and homogeneous coatings could not be formed.

EXAMPLE 4

The process and paints of Example 2, Table 5 were followed, however several different acids were tested. Unless noted, the polymer was 2.5 grams per liter Copolymer 2 and all acids were 0.12 Normal.

TABLE 7

| Acid | Coating Weight (mg/ft2) | Cross-Hatch Plus 40 in-lb Reverse Impact (c) | Boiling Water Cross-Hatch Plus 40 in-lb Reverse Impact (c) | T-Bend | Wedge Bend Loss (mm) |
|---|---|---|---|---|---|
| $H_2ZrF_6$ | 23.4 | 10 | 10 | 2 | 15 |
| $H_2TiF_6$ | 25.2 | 10 | 10 | 1 | 0 |
| $H_2ZrF_6$ + $H_2TiF_6$ (a) | 24.6 | 10 | 10 | 1 | 7 |
| $H_2ZrF_6$ (b) | 13.8 | 10 | 10 | 2 | 7 |
| $H_2TiF_6$ (b) | 15.6 | 10 | 10 | 1 | 2 |
| $H_2SiF_6$ | 10.2 | 10 | 10 | 2 | 2 |
| $HBF_4$ | 18.6 | 10 | 6 | 2 | 8 |
| $CH_3COOH$ | 2.4 | 10 | 10 | 1 | 3 |
| $H_3PO_4$ | 5.4 | 8 | 0 | 4 | 25 |
| $H_2SO_4$ | 9.0 | 8 | 0 | 2 | 18 |
| Citric | 1.8 | 10 | 0 | 2 | 15 |

(a) 6.1 g/l $H_2ZrF_6$ plus 6.1 g/l $H_2TiF_6$; 0.13 N total
(b) 6.1 g/l
(c) rating These data indicate the utility of lower concentrations of dihydrofluozirconic acid and dihydrofluotitanic acids, combinations of these two acids, as well as for dihydrofluosilicic, fluoboric and acetic acids.

The data from Example 4 shows the utility of lower concentrations of dihydrofluozirconic acid and dihydrofluotitanic acid, combinations of these two acids, as well as dihydrofluosilicic acid, fluoboric acid, and acetic acid.

EXAMPLE 5

The process of Example 1 was followed using 2.5 grams per liter of Copolymer 1 of Table I in the free acid form. PPG Duracron 1000 paint was applied after treatment. The copolymer was used alone and in combination with selected acids. When used alone, the polymer was the sole source of acidity. Table 8 summarizes the results.

TABLE 8

| Acid | pH | Coating Weight (mg/ft2) | T-Bend | Wedge Bend | 500 hr avg. Scribe | AASS** avg. field |
|---|---|---|---|---|---|---|
| none | 2.76 | 1.8 | 1 | 0 | 9.3 | 10 |
| 7 g/l acetic | 2.63 | 1.2 | 1 | 0 | 9.3 | 10 |
| 7 g/l glycolic | 2.33 | 1.8 | 2 | 20 | 8.5 | 10 |
| 12 g/l $H_2ZrF_6$ | * | 18.6 | 2 | 10 | 8.3 | 10 |
| 12 g/l $H_2ZrF_6$ | * | 16.8 | 2 | 0 | 7.5 | 10 |

*pH values for these two acids are unreliable due to an electrode interference.
**AASS denotes acetic acid salt spray All reverse impact, boiling water+reverse impact, and QCT condensing humidity ratings equalled 10 for all systems tested.

Table 8 shows that all of the tested acids as well as polymer alone gave good performance. In spite of the relatively low coating weights, acetic acid and polymer alone gave the best results in this test.

EXAMPLE 6

Test panels of 6061 aluminum alloy, (typical of extruded aluminum articles) were spray cleaned in an alkaline cleaner, rinsed in water, deoxidized with a mixture of nitric acid and ammonium fluoride, rinsed in water, and then spray-treated with 0.7 grams per liter of $H_2ZrF_6$ mixed with either polyacrylic acid or Copolymer 2 of Table I. The test panels were painted with PPG Polycron III or PPG Flexanar and subjected to acetic acid salt spray 1000 hour testing. Table 9 summarizes the results.

TABLE 9

| Polymer | Polymer Dose (g/l) | Paint | Scribe Ratings | Field Ratings |
|---|---|---|---|---|
| PAA | 0.6 | Polycron III | 5, 5 | 3, 3 |
| Copolymer 2 | 0.5 | Polycron III | 7, 7 | 4, 4 |
| Copolymer 2 | 1.0 | Polycron III | 7.5, 7 | 5, 4 |
| Copolymer 2 | 2.5 | Polycron III | 6, 7 | 5, 5 |
| PAA | 0.6 | Flexanar | 8, 8 | 8, 8 |
| Copolymer 2 | 0.5 | Flexanar | 6, 8 | 9, 10 |
| Copolymer 2 | 1.0 | Flexanar | 7, 7 | 10, 10 |
| Copolymer 2 | 2.5 | Flexanar | 7, 7 | 10, 10 |

The data of Table 9 shows the effectiveness of lower polymer doses in spray applications.

It should be understood that the foregoing description of this invention is not intended to be limiting, but is only exemplary of the inventive features which are defined in the claims.

What is claimed is:

1. A method of forming a dried in place conversion coating on an aluminum or aluminum alloy surface comprising:

contacting the aluminum surface with an aqueous solution of water soluble or water dispersible polymer having repeat units represented by the formula

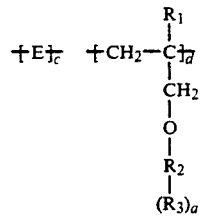

wherein E is the repeat unit remaining after polymerization of an alpha, beta ethylenically unsaturated compound, $R_1$ is H or lower (C1-C4) alkyl, $R_2$ is

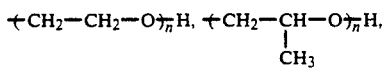

monohydroxylated C1-C8 alkyl, monohydroxylated C1-C8 alkylene, di- or polyhydroxy C1-C8 alkylene, n is an integer of from 1 to about 20, a is 0 or 1, $R_3$ is hydrogen or an acetate formed by reacting an acetylating agent with an allyl ether, the molar ratio of repeat units c:d is from about 15:1 to about 1:10; and optionally an acid selected from the group consisting of acetic acid, glycolic acid, dihydrohexafluotitanic acid, dihydrohexafluosilicic acid, dihydrohexafluozirconic acid and fluoboric acid; and drying said aqueous solution in place.

2. The method of claim 1 wherein said water soluble or water dispersible polymer has a molecular weight (Mn) of from about 1,000 to 100,000.

3. The method of claim 1 wherein said water soluble or water dispersible polymer has a molecular weight (Mn) of from about 1,000 to 30,000.

4. The method of claim 3 wherein said water soluble or water dispersible polymer has a molecular weight (Mn) of from about 2,500 to 25,000.

5. The method of claim 1 wherein E is the repeat unit obtained from the polymerization of acrylic or maleic acid.

6. The method of claim 1 wherein $R_1$ is H, $R_2$ is 2-hydroxypropyl, and a=0.

7. The method of claim 1 wherein $R_1$ is H, $R_2$ is $-CH_2-CH_2-O-_nH$, a=0, and n is about 1 to 15.

8. The method of claim 1 wherein $R_2$ is

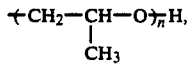

$R_1$ is H, n is about 1 to 15 and a=0.

9. The method of claim 1 wherein the pH of said aqueous solution is from 1.5 to 3.5.

* * * * *